US010260351B2

(12) United States Patent
Parkin et al.

(10) Patent No.: US 10,260,351 B2
(45) Date of Patent: Apr. 16, 2019

(54) FAN BLADE AND METHOD OF MANUFACTURING SAME

(75) Inventors: Michael Parkin, South Glastonbury, CT (US); James O. Hansen, Glastonbury, CT (US); Christopher J. Hertel, Wethersfield, CT (US); David R. Lyders, Middletown, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 1514 days.

(21) Appl. No.: 13/422,541

(22) Filed: Mar. 16, 2012

(65) Prior Publication Data

US 2013/0239586 A1 Sep. 19, 2013

(51) Int. Cl.

| | |
|---|---|
| ***F01D 5/28*** | (2006.01) |
| ***F04D 29/32*** | (2006.01) |
| ***F01D 5/14*** | (2006.01) |

(52) U.S. Cl.

CPC ..... *F01D 5/147* (2013.01); *F01D 5/282* (2013.01); *F04D 29/324* (2013.01); *F05D 2220/36* (2013.01); *F05D 2240/303* (2013.01); *Y10T 156/10* (2015.01)

(58) Field of Classification Search

CPC ..... F01D 5/147

See application file for complete search history.

(56) References Cited

U.S. PATENT DOCUMENTS

| | | | | |
|---|---|---|---|---|
| 3,739,745 | A | 6/1973 | Turpin | |
| 3,762,835 | A * | 10/1973 | Carlson et al. | 416/224 |
| 7,955,054 | B2 * | 6/2011 | El-Aini et al. | 416/146 R |
| 8,047,799 | B2 * | 11/2011 | Nies | 416/232 |
| 2007/0231156 | A1 | 10/2007 | Hong | |
| 2007/0286706 | A1 | 12/2007 | Takagi | |
| 2010/0028160 | A1 * | 2/2010 | Schaeffer | F01D 5/005 416/224 |
| 2011/0206534 | A1 | 8/2011 | Riahi | |
| 2011/0211967 | A1 * | 9/2011 | Deal et al. | 416/224 |

FOREIGN PATENT DOCUMENTS

| | | |
|---|---|---|
| GB | 121 420 | 12/1918 |

* cited by examiner

*Primary Examiner* — David E Sosnowski

(74) *Attorney, Agent, or Firm* — Carlson, Gaskey & Olds, P.C.

(57) ABSTRACT

An airfoil for a gas turbine engine includes a substrate and a sheath providing an edge. A cured adhesive secures the sheath to the substrate. The cured adhesive has a fillet that extends beyond the edge that includes a mechanically worked finished surface. A method of manufacturing the airfoil includes the steps of securing a sheath to a substrate with adhesive, curing the adhesive, and mechanically removing a portion of the adhesive extending beyond the sheath.

16 Claims, 2 Drawing Sheets

FAN BLADE AND METHOD OF MANUFACTURING SAME

BACKGROUND

This disclosure relates to an airfoil for a gas turbine engine.

Hybrid metal fan blades have been proposed in which a metallic sheath is secured to an aluminum substrate. One example metallic sheath is a titanium structure, which provides for a lightweight airfoil. The sheath is typically secured to a leading edge of the substrate to provide resistance to damage from debris. One approach has been to secure the sheath to the substrate using an adhesive. Unfortunately, in such conventional blades, when a corrosion preventative film adhesive layer was used, it often left a fillet of adhesive at the sheath edge, which inhibited proper urethane coating.

SUMMARY

In one embodiment, an airfoil for a gas turbine engine includes a substrate and a sheath providing an edge. An adhesive secures the sheath to the substrate. The adhesive has a fillet that extends beyond the edge that includes a finished surface.

In a further embodiment of any of the above, the substrate is a first metal and the sheath is a second metal different than the first metal.

In a further embodiment of any of the above, the adhesive is configured to provide a barrier between the first and second metals to prevent galvanic corrosion.

In a further embodiment of any of the above, the adhesive includes a scrim embedded in resin.

In a further embodiment of any of the above, the scrim is provided beneath the sheath and inboard of the edge.

In a further embodiment of any of the above, the finished surface includes a scraped contour.

In a further embodiment of any of the above, the airfoil includes a coating arranged over the substrate and the finished surface. The coating abuts the edge.

In a further embodiment of any of the above, the airfoil is a fan blade and the sheath provides a leading edge of the airfoil.

In a further embodiment of any of the above, the sheath includes a flank providing the edge.

In another embodiment, the airfoil includes a body having first, second, and third surfaces. The first and second surfaces are adjacent to one another and are generally at a right angle to one another. The third surface adjoins the second surface at an obtuse angle and provides a sharp edge configured to scrape a cured adhesive. The first and second surfaces are configured to follow an airfoil sheath contour.

In a further embodiment of any of the above, a relief aperture adjoins the first and second surfaces to one another and is configured to accommodate a corner of the airfoil sheath contour.

In another embodiment, a method of manufacturing an airfoil for a gas turbine engine includes the steps of securing a sheath to a substrate with adhesive, curing the adhesive, and mechanically removing a portion of the adhesive extending beyond the sheath.

In a further embodiment of any of the above, the securing step includes providing a resin-saturated scrim between the sheath and substrate.

In a further embodiment of any of the above, the curing step includes providing a fillet of adhesive adjoining the sheath and the substrate.

In a further embodiment of any of the above, the removing step includes scraping the fillet with a tool to provide a finished surface on the adhesive. In a further embodiment of any of the above, the method of manufacturing includes the step of applying a coating over the substrate and the finished surface and adjoining the sheath. The coating provides a fan blade contour along with the sheath.

In another embodiment, a gas turbine engine includes a fan section. The fan section includes a plurality of fan blades, at least one of said fan blades includes a substrate, a sheath providing an edge, and a cured adhesive that secures the sheath to the substrate. The cured adhesive has a fillet that extends beyond the edge that includes a mechanically worked finished surface.

In a further embodiment of any of the above, the gas turbine engine includes a compressor section, a combustor section in fluid communication with the compressor section, and a turbine section in fluid communication with the combustor section.

In a further embodiment of any of the above, the compressor section includes a high pressure compressor section and a low pressure compressor section. The turbine section includes a high pressure turbine section and a low pressure turbine section. The high pressure turbine section is engaged with the high pressure compressor section via a first spool and the low pressure turbine section is engaged with the low pressure compressor section via a second spool.

In a further embodiment of any of the above, the gas turbine engine includes a geared architecture that engages both the low spool and the fan section.

BRIEF DESCRIPTION OF THE DRAWINGS

The disclosure can be further understood by reference to the following detailed description when considered in connection with the accompanying drawings wherein.

DETAILED DESCRIPTION

Figure 1:
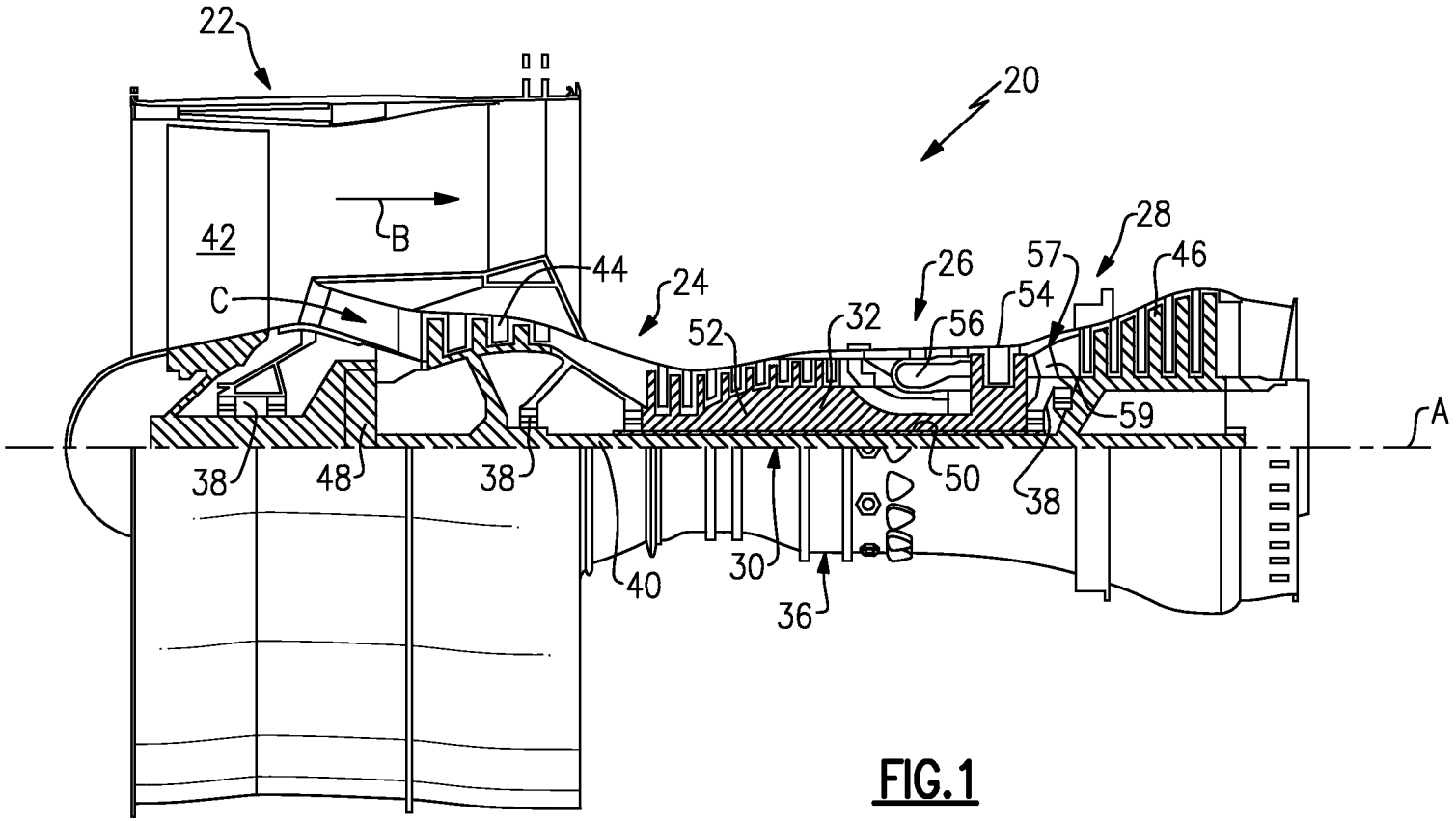
FIG. 1 is a schematic, cross-sectional side view of an embodiment of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath B while the compressor section 24 drives air along a core flowpath C for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines including three-spool architectures.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure (or first) compressor section 44 and a low pressure (or first) turbine section 46. The inner shaft 40 is connected to the fan 42 through a geared architecture 48 to drive the fan 42 at a lower speed than the low speed spool 30. The high speed spool 32 includes an outer shaft 50 that interconnects a high pressure (or second) compressor section 52 and high pressure (or second) turbine section 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 supports one or more bearing systems 38 in the turbine section 28. The inner shaft 40 and the outer shaft 50 are concentric and rotate via bearing systems 38 about the engine central longitudinal axis A, which is collinear with their longitudinal axes. As used herein, a "high pressure" compressor or turbine experiences a higher pressure than a corresponding "low pressure" compressor or turbine.

The core airflow C is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path. The turbines 46, 54 rotationally drive the respective low speed spool 30 and high speed spool 32 in response to the expansion.

The engine 20 in one example is a high-bypass geared aircraft engine. In a further example, the engine 20 bypass ratio is greater than about six (6), with an example embodiment being greater than ten (10), the geared architecture 48 is an epicyclic gear train, such as a star gear system or other gear system, with a gear reduction ratio of greater than about 2.3 and the low pressure turbine 46 has a pressure ratio that is greater than about 5. In one disclosed embodiment, the engine 20 bypass ratio is greater than about ten (10:1), the fan diameter is significantly larger than that of the low pressure compressor 44, and the low pressure turbine 46 has a pressure ratio that is greater than about 5:1. Low pressure turbine 46 pressure ratio is pressure measured prior to inlet of low pressure turbine 46 as related to the pressure at the outlet of the low pressure turbine 46 prior to an exhaust nozzle. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned per hour divided by lbf of thrust the engine produces at that minimum point. "Fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tambient deg R)/518.7)^0.5]. The "Low corrected fan tip speed" as disclosed herein according to one non-limiting embodiment is less than about 1150 ft/second.

Figure 2:
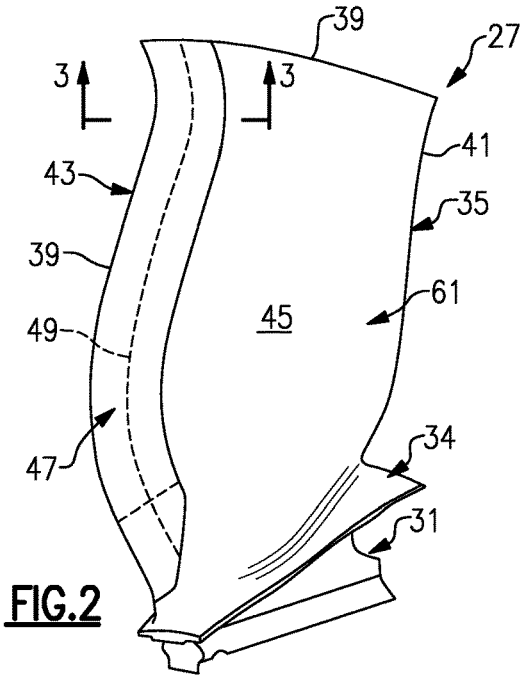
FIG. 2 is a perspective view of an embodiment of a fan blade of the engine shown in FIG. 1.
Figure 3:
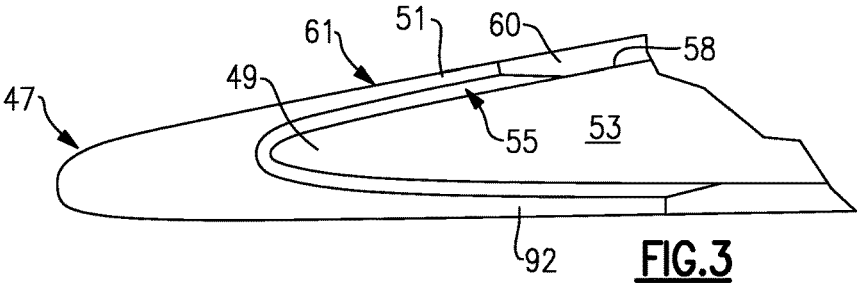
FIG. 3 is a cross-sectional view of the fan blade shown in FIG. 2 taken along line 3-3.

Referring to FIGS. 2 and 3, a fan blade 27 of the fan 42 includes a root 31 supporting a platform 34. An airfoil 35 extends from the platform 34 to a tip 39. The airfoil 35 includes spaced apart leading and trailing edges 39, 41. Pressure and suction sides 43, 45 adjoin the leading and trailing edges 39, 41 to provide a fan blade contour 61.

The fan blade 27 includes a substrate 53 with an edge 49. A sheath 47 is secured to the substrate 53 over the edge 49 with adhesive 55. In one example, the sheath 47 and the substrate 53 are constructed from first and second metals that are different from one another. In one example, the substrate 53 is constructed from an aluminum alloy, and the sheath 47 is constructed from a titanium alloy. It should be understood that other metals or materials may be used.

Figure 4:
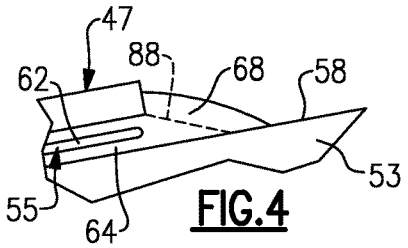
FIG. 4 is an enlarged cross-sectional view of the fan blade shown in FIG. 2 illustrating an adhesive fillet provided between a sheath and a substrate subsequent to curing.

The adhesive 55 provides a barrier between the substrate 53 and the sheath 47 to prevent galvanic corrosion. Referring to FIG. 4, the adhesive 55 includes a scrim 62 (e.g., a glass scrim) that carries a resin 64. Examples of the adhesive 55 include a variety of commercially available aerospace-quality metal-bonding adhesives are suitable, including several epoxy- and polyurethane-based adhesive films. In some embodiments, the adhesive 55 is heat-cured via autoclave or other similar means. Examples of suitable bonding agents include type EA9628 epoxy adhesive available from Henkel Corporation, Hysol Division, Bay Point, Calif. and type AF163K epoxy adhesive available from 3M Adhesives, Coatings & Sealers Division, St. Paul, Minn.

In certain embodiments, such as is shown in FIG. 3, the adhesive 55 is a film, which also contributes a minute amount of thickness of blade 27 proximate the sheath 47. In one example, a layer of adhesive film is about 0.005-0.010 inch (1.2-2.5 mm) thick. Despite the additional thickness, a film-based adhesive allows for generally uniform application, leading to a predictable thickness of airfoil 35 proximate forward airfoil edge 39.

Certain adhesives 55, including the example film-based adhesives above, are compatible with scrim 62. Scrim 62 provides dielectric separation between airfoil 35 and sheath 47, preventing galvanic corrosion between the two different metal surfaces of airfoil 35 and sheath 47. The material forming scrim 62 is often determined by its compatibility with adhesive 55. One example scrim 62 is a flexible nylon-based layer with a thickness between about 0.005 inch (0.12 mm) and about 0.010 inch (0.25 mm) thick. Other examples of the adhesive 55 and other aspects of the fan blade 27 are set forth in U.S. Patent Application Publication 2011/0211967 to the Applicant, which is incorporated herein by reference in its entirety.

Figure 6:
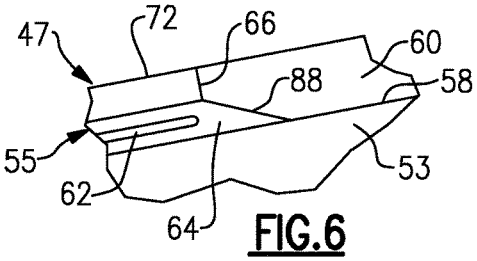
FIG. 6 is a cross-sectional view of a portion of the fan blade shown in FIG. 2 with a coating applied over the substrate and the finished surface.

Returning to FIG. 3, the sheath 47 includes first and second flanks 51, 91 that are arranged on either side of the edge 49. The adhesive 55, when cured, flows beyond the sheath edge and creates a fillet 68 bridging an edge 66 of the sheath 47 and a surface 58 of the substrate 53. In the area of the fillet 68, the sheath 47 provides spaced apart interior and exterior surfaces 70, 72 adjoined by the edge 66. A corner 74 is provided at the intersection of the edge 66 and the exterior surface 72, which may be provided at a generally right angle relative to one another. The scrim 62 is provided beneath the sheath 47 and arranged inboard of the edge 66. Typically, the fillet 68 is larger than desired and is of variable size, which prevents the desired surface profile of an applied coating 60 over the adhesive 55, the edge 66 and the surface 58, as illustrated in FIGS. 3 and 6. The coating 60, which may be urethane, for example, provides the desired fan blade contour 61.

To reduce the size of the fillet 68, a tool 76 is used to mechanically remove a portion of the fillet 68 to provide a mechanically worked finished surface 88. The adhesive 55 may be cured using a vacuum bag and autoclave, which provides a cured exterior surface having visible attributes such as a relatively smooth texture and/or a glossy or matte surface finish. The mechanically worked surface finish 88, by way of contrast, will have, for example, striations and/or machining marks left by a tool. The structural characteristics and difference between the cured exterior surface and the mechanically worked surface finish 88 may be appreciated based upon a visual inspection of the part. The mechanically worked finished surface 88 is provided at or below the interior surface 70 to sufficiently expose the edge 66 and provide a desired and consistent bonding surface for the coating 60 between the edge 66 and the surface 58.

Figure 5:
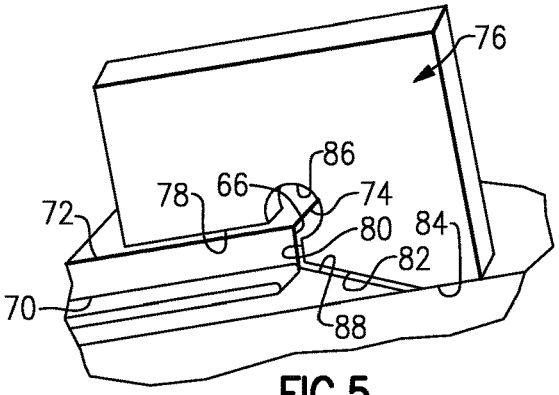
FIG. 5 is a perspective view of a tool used to remove a portion of the fillet shown in FIG. 4 to provide a finished surface on the adhesive.

The tool 76, which is illustrated in FIG. 5, includes first, second, third and fourth surfaces 78, 80, 82, 84. The first and second surfaces 78, 80 are adjacent to one another and arranged at generally a right angle relative to one another. The first and second surfaces 78, 80 are respectively configured to follow the exterior surface 72 and the edge 66. The third surface 82 adjoins the second surface 80 at an obtuse angle. The third surface 82 provides a sharp edge that is configured to scrape the fillet 68 and provide the mechanically worked finished surface 88. The mechanically worked finished surface 88 includes a scraped contour in the example embodiment. The fourth surface 84 adjoins the third surface 82 and is configured to follow the surface 58 of the substrate 53 without damaging the substrate. Tool surfaces 78 and 84 preferably have rounded edges to preclude damaging the sheath substrate (exterior surface 72) or the airfoil substrate (surface 58) during the scraping procedure.

In one example, a relief aperture 86, which may be a generally circular hole in one example, adjoins the first and second surfaces 78, 80 to one another to accommodate the corner 74 of the sheath 47. Once the mechanically worked finished surface 88 has been provided on the adhesive 55, the coating 60, which may be urethane in one example, is applied over the edge 66, the finished surface 88 and the surface 58 to provide the fan blade contour 61.

As a result of the foregoing fan blade embodiment, the problem in conventional blades (i.e., where a corrosion preventative film adhesive layer often left a fillet of adhesive at the sheath edge that inhibited proper urethane coating) has been resolved.

Although an example embodiment has been disclosed, a worker of ordinary skill in this art would recognize that certain modifications would come within the scope of the claims. For example, other mechanical methods may be used to remove portions of the fillet 68 to expose the edge 66. For that reason, the following claims should be studied to determine their true scope and content.

What is claimed is:

1. An airfoil for a gas turbine engine, comprising:
- a substrate;
- a sheath providing an edge;
- a cured adhesive securing the sheath to the substrate, the cured adhesive having a fillet extending adjacent to and beyond the edge from underneath the sheath, the fillet including a mechanically worked finished surface, the fillet leaving a portion of the edge exposed; and
- a coating arranged over the substrate and the mechanically worked finished surface, the coating abutting the portion of the edge.

2. The airfoil according to claim 1, wherein the substrate is a first metal and the sheath is a second metal different than the first metal.

3. The airfoil according to claim 2, wherein the cured adhesive is configured to provide a barrier between the first and second metals to prevent galvanic corrosion.

4. The airfoil according to claim 3, wherein the cured adhesive includes a scrim embedded in resin.

5. The airfoil according to claim 4, wherein the scrim is provided beneath the sheath and inboard of the edge.

6. The airfoil according to claim 1, wherein the mechanically worked finished surface includes a scraped contour.

7. The airfoil according to claim 1, wherein the airfoil is a fan blade, and the sheath provides a leading edge of the airfoil.

8. The airfoil according to claim 1, wherein the sheath includes a flank providing the edge.

9. A method of manufacturing an airfoil for a gas turbine engine, comprising the steps of:
- securing a sheath to a substrate with adhesive, wherein the adhesive flows beyond an edge of the sheath;
- curing the adhesive;
- mechanically removing a portion of the adhesive that flowed beyond the edge to leave a fillet extending beyond and from beneath the sheath and to expose a portion of the edge; and
- applying a coating over the substrate and the mechanically worked finished surface and adjoining the portion of the edge, the coating providing a fan blade contour along with the sheath.

10. The method according to claim 9, wherein the securing step includes providing a resin-saturated scrim between the sheath and substrate.

11. The method according to claim 9, wherein the curing step includes providing the fillet of cured adhesive adjoining the sheath and the substrate.

12. The method according to claim 11, wherein the removing step includes scraping the fillet with a tool to provide a mechanically worked finished surface on the cured adhesive.

13. A gas turbine engine comprising:
- a fan section comprising a plurality of fan blades, at least one of said fan blades comprising:
- a substrate;
- a sheath providing an edge; and
- a cured adhesive securing the sheath to the substrate, the cured adhesive having a fillet extending adjacent to and beyond the edge from underneath the sheath, the fillet including a mechanically worked finished surface, the fillet leaving a portion of the edge exposed, and a coating arranged over the substrate and the mechanically worked finished surface, the coating abutting the portion of the edge.

14. The gas turbine engine according to claim 13, further comprising:
- a compressor section;
- a combustor section in fluid communication with the compressor section; and a turbine section in fluid communication with the combustor section.

15. The gas turbine engine according to claim 13, wherein the compressor section includes a high pressure compressor section and a low pressure compressor section, wherein the turbine section includes a high pressure turbine section and a low pressure turbine section, wherein the high pressure turbine section is engaged with the high pressure compressor section via a first spool and the low pressure turbine section is engaged with the low pressure compressor section via a second spool.

16. The gas turbine engine according to claim 15, further comprising:

a geared architecture that engages both the second spool and the fan section.

* * * * *